US007475658B2

(12) United States Patent
Karbstein et al.

(10) Patent No.: US 7,475,658 B2
(45) Date of Patent: Jan. 13, 2009

(54) ELECTROHYDRAULIC CONTROL MODULE

(75) Inventors: Henning Karbstein, Charlotte, NC (US); Thomas Kremer, Fürth (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/753,038

(22) Filed: May 24, 2007

(65) Prior Publication Data

US 2007/0272181 A1 Nov. 29, 2007

Related U.S. Application Data

(60) Provisional application No. 60/802,930, filed on May 24, 2006.

(51) Int. Cl.
*F01L 9/02* (2006.01)

(52) U.S. Cl. ..... 123/90.12; 123/90.13; 123/90.33; 123/90.38; 123/193.3; 277/591

(58) Field of Classification Search ..... 123/90.12, 123/90.13, 90.33, 90.38, 193.3, 198 F; 277/591, 277/652

See application file for complete search history.

(56) References Cited

U.S. PATENT DOCUMENTS 6,481,409 B1 11/2002 Wade et al.
7,007,641 B1 * 3/2006 Kryglowski et al. ..... 123/90.11
7,032,564 B1 * 4/2006 Kryglowski et al. ..... 123/198 F

FOREIGN PATENT DOCUMENTS

DE 102004011638 9/2005

* cited by examiner

*Primary Examiner*—Ching Chang
(74) *Attorney, Agent, or Firm*—Volpe and Koenig, P.C.

(57) ABSTRACT

An electrohydraulic control module is provided for making available a compressed fluid, especially compressed oil for actuators, which are used for actuating control units, for example, for switching gas-exchange valves of an internal combustion engine on and off, with a control housing, which is attached to a connection part of the internal combustion engine and which has electrical switching valves that are connected to an oil supply line and to control oil lines leading to the actuators. The production and assembly expense of the electrohydraulic control modules is reduced in that an intermediate housing (6), which is injection molded from plastic and which has at least the oil supply line and the control oil lines (17), is clamped between the connection part (5) and the control housing (7).

7 Claims, 2 Drawing Sheets

ELECTROHYDRAULIC CONTROL MODULE

CROSS-REFERENCE TO RELATED APPLICATIONS

This application claims the benefit of U.S. Provisional Application No. 60/802,930, filed May 24, 2006, which is incorporated herein by reference as if fully set forth.

BACKGROUND

The invention relates to an electrohydraulic control module for making available a compressed fluid, especially compressed oil for actuators that are used for actuating control units, for example, for switching gas-exchange valves of an internal combustion engine on and off, comprising a control housing that is attached to a connection part of the internal combustion engine and that has electric switching valves, which are connected to an oil-supply line and to control lines leading to the actuators.

Such an electrohydraulic control module is described in DE 102 00 4011 638 A1. Deactivating and activating cylinders is used for adapting the piston displacement of the engine to the corresponding power requirements. The lower the required power, the lower the active piston displacement should be. Controlling the engine output by regulating the piston displacement leads to throttling losses and the associated increase in consumption.

In V-engines, the piston displacement is regulated by deactivating and activating the cylinders of one side of the engine. Deactivating the cylinders is performed by locking the closed gas-exchange valves of these cylinders. Hydraulic actuators with pistons that actuate the locking pins are used for this purpose.

Outside of electrohydraulic control modules for deactivating cylinders, those for control systems for transmissions, especially automatic transmissions, are also known. The control module according to the invention also relates to these.

The electrohydraulic control module described in the class-forming publication has a one-piece construction. Its assembly and testing expense is relatively low, but the production expense is relatively high due to the exclusive use of processing involving cutting. This applies primarily for the manufacturing of oil supply lines that extend as bores over the greatest part of the length of the control module.

In U.S. Pat. No. 6,481,409 B1, another electrohydraulic control module is described. This has a multiple-piece construction with a top plate in which the channels are partially machined, with an attached sealing plate that closes the channels, with a closing plate, and with additional holding plates for the switching valves. The plates are sealed from each other and screwed with several screws that also guarantee the attachment of the control module to the crankcase of the internal combustion engine.

This solution is very complicated and expensive because processing of the sealing surfaces is required despite the integrated channels. The large number of parts results in a correspondingly high assembly expense. In addition, the number of seals and the length of the sealing distances put the service life of the seals at risk.

A similarly constructed electrohydraulic control module is described in U.S. Pat. No. 6,439,176 B1. This also involves a multiple-part device that is expensive in production and assembly and that is susceptible to failure.

SUMMARY

The invention is based on the objective of creating a control module according to the invention, which is to be produced and mounted economically.

The objective of the invention is met in that an intermediate housing injection molded from plastic, which has at least the oil supply line and the control oil lines, is clamped between the connection part and the control housing. The plastic injection molding offers the possibility of molding the intermediate housing with the oil supply line and the control oil lines into a final product in one processing step without finishing work involving cutting. In addition, the cut oil supply line of the control housing of a single-housing solution is discontinued, so that the solution according to the invention has lower production and assembly expense than the single-housing solution despite the increased number of components.

One advantageous construction of the invention is provided in that the oil supply line is constructed as a channel that is open towards the control housing and that is surrounded by a seal integrated in the plastic and closed by the control housing with its switching valves. The molding of the open channel and the closing of this channel take place without additional expense in molding and assembling the intermediate housing.

It offers advantages in that the channel is in fluid connection via an oil supply line with a compressed oil connection of the connection part, wherein the oil supply line is constructed as a passage line, whose ends are surrounded by an integrated seal. Therefore, the oil is led over short paths and with low flow losses into the channel and to the switching valves, whereby a rapid activation and deactivation of the cylinders is guaranteed.

It is advantageous that the control oil lines in the intermediate housing are constructed as passage lines, whose ends are surrounded by integrated seals and with which fitting control oil lines of the control housing and the connection part are connected in a pressure-tight way. In this way, the control oil lines are connected in a pressure tight-way without additional expense when the control and intermediate housings are attached to the connection part of the internal combustion engine.

An advantageous construction of the invention is provided in that the integrated seals are constructed as closed elastomer cords, which are preferably connected to each other and to the plastic through the molding process. In this way, the placement of the elastomer cords in the die is simplified and a captive connection of the intermediate housing and integrated seals is guaranteed.

It is advantageous that oil-free passage bores aligned with each other are provided in the control housing and in the intermediate housing. Through these bores, screws for attaching the control module into the connection part are inserted, which are simultaneously used as a guide for the control and the intermediate housings.

A further advantage is also that the profile of the channel extending in the longitudinal direction of the intermediate housing is adapted through corresponding bends in this channel to the position and size of the switching valves and the oil feed lines as well as to one of the oil-free passage bores. Therefore, it is possible to realize a sufficiently large flow cross section of the channel for at most the same overall height as the intermediate housing despite a width of the channel that is dependent on the seal.

It is also advantageous when the intermediate housing is constructed with the channel and the control oil lines as well as with the oil feed line and the oil-free passage bores with an undercut-free construction in the direction of opening of the injection molding tool. Therefore, the production and operating costs of slides in the injection-molding die are eliminated.

BRIEF DESCRIPTION OF THE DRAWINGS

Additional features of the invention emerge from the following description and the drawings, in which the invention is shown schematically.

Shown are.

DETAILED DESCRIPTION OF THE PREFERRED EMBODIMENTS

Figure 1:
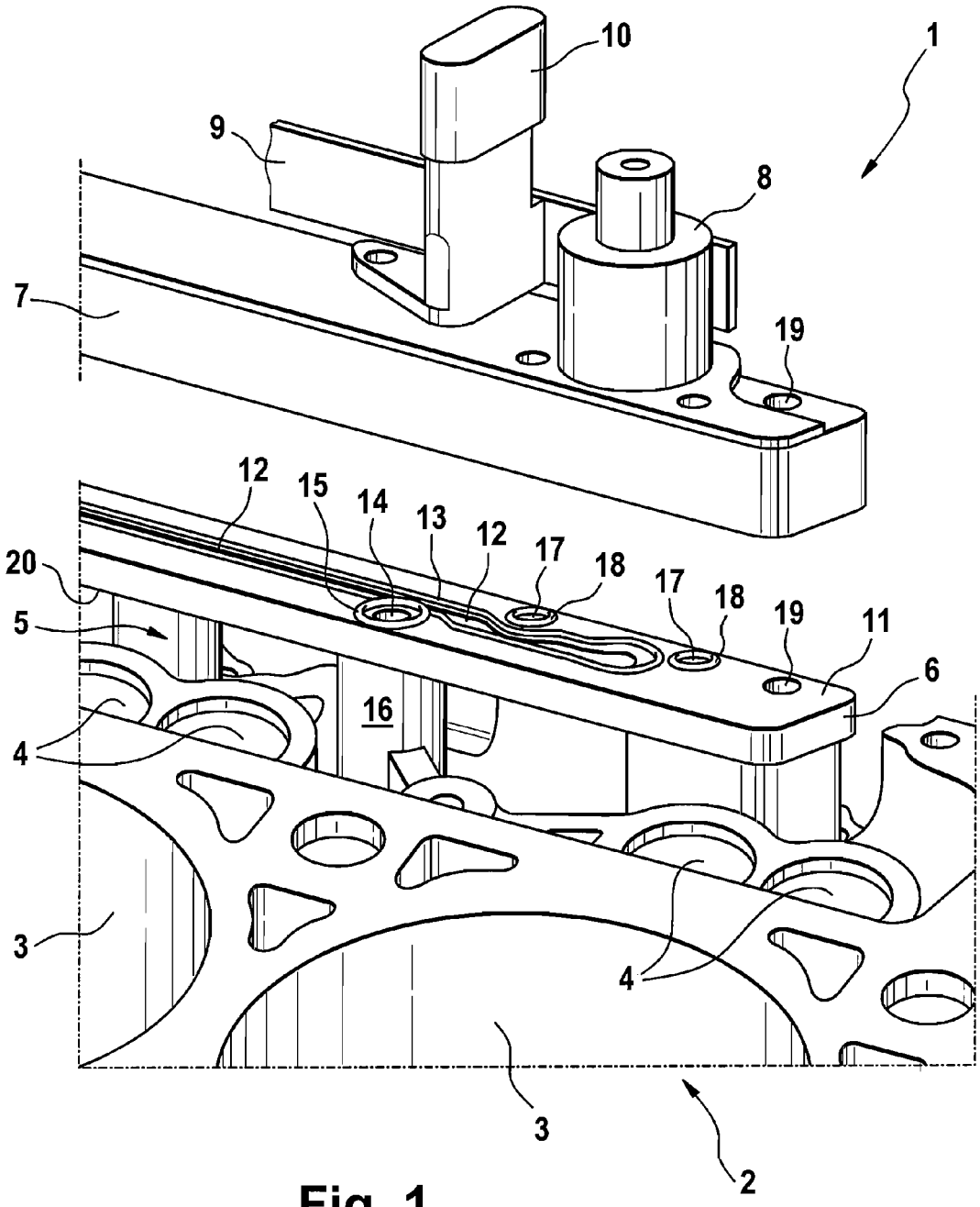
FIG. 1 a partial perspective view of an electrohydraulic control module with an intermediate house according to the invention in the installation position on a crankcase.

FIG. 1 shows in a perspective projection the installation situation of an electrohydraulic control module 1, which is attached to a crankcase 2 of a not-shown combustion engine. This is a 6-cylinder V-engine, which has two rows of cylinders each with three cylinders 3 set at an angle to each other in the shape of a V. In FIG. 1, two cylinders 3 can be seen with the associated tappet guides 4.

Not-shown parts of the valve train, such as the camshaft, tappet, and actuators, are located underneath the tappet guides 4. Above the tappet guides 4 are parts of a connection part 5 of the combustion engine, to which the control module 1 is attached.

The control module 1 has an intermediate housing 6 according to the invention and a control housing 7. The intermediate housing 6 is located in the installation position and contacts the connection part 5 with its bottom side 20 (see also FIG. 2*a*). The control housing 7 is shown lifted from the intermediate housing for illustrating the intermediate housing 6.

FIG. 1 also shows one of three electrical switching valves 8 of one row of cylinders, which are connected to each other by a current rail 9 and to a current plug 10.

On the top side 11 of the intermediate housing 6 there is a seal 13, which surrounds an open channel 12 extending over the greatest part of the length of the control module 1.

Figure 2A:
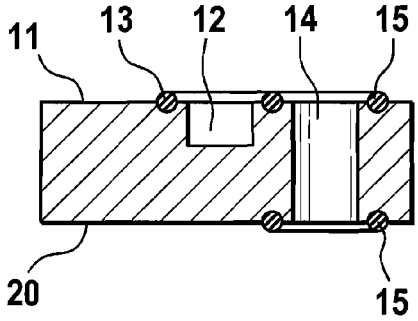
FIG. 2*a* a cross sectional view taken along line A-A through the intermediate housing of FIG. 2.

An oil feed line 14 constructed as a passage line in the intermediate housing 6 is surrounded at both ends with a seal 15, as shown in FIG. 2*a*.

The oil feed line 14 connects the channel 12 with an oil connection 16 of the connection part 5.

In the same way, control oil lines 17 in the intermediate housing 6 are constructed as passage positions, which are surrounded at both ends with a seal 18.

Aligned, oil-free passage bores 19, which are used for guiding not-shown screws for the attachment of the control and intermediate housing 7, 6 on the connection part 5, are provided in the control housing 7 and in the intermediate housing 6. Through screw connections, the channel 12, the oil feed line 14, and the control oil lines 17 are brought into fluid connection with the associated lines of the control housing 7 and the connection part 5 and are sealed by the seals 13, 15, 18.

The contact force of the seals 15, 18 necessary for tightness is guaranteed by their contact on the connection part 5. For the not-supported areas of the seal 13, for achieving the contact force a corresponding flexural strength of the intermediate housing 6 is necessary. The dependent overall height of this component can be influenced through the arrangement of parts of the intermediate housing 6, e.g., an oil filter, in open spaces underneath the connection part 5.

Figure 2:
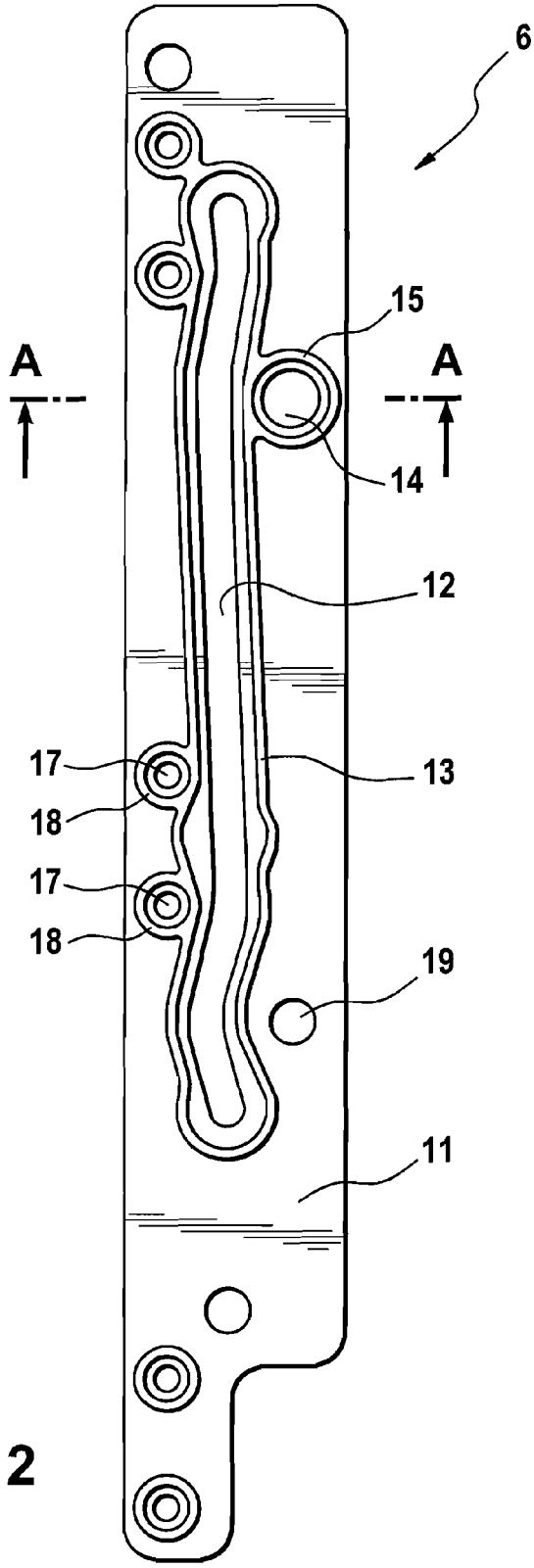
FIG. 2 a top view of the intermediate housing of FIG. 1.

In FIG. 2, the intermediate housing 6 according to the invention is shown in a top view and in FIG. 2*a* along section A-A of this housing. In the top side 11 of the intermediate housing 6 there is a channel 12, which is used for supplying oil to the switching valves 8. These lie on a straight line, as can be seen by expanding the spacing of the seal 13, from which the center line of the channel 12 deviates through bends. The bends are necessary due to the width of the channel 12 bounded by the integrated seal 13 and due to the position and width of the oil feed line 14 and its integrated seal 15 and also due to the position of one of the oil-free passage bores 19. Therefore, it is possible to realize a sufficiently large flow cross section of the channel 12 in the frame of the stiffness-dependent overall height of the intermediate housing 6 despite the sealing-dependent width of the channel 12 and the oil feed line 14.

A connection of the integrated seals 13 of the channel 12 and 15 of the oil feed line 14 and also 18 of the control oil lines 17 on the top side 11 of the intermediate housing 6 simplify their placement in the injection-molding die.

LIST OF REFERENCE NUMBERS

1 Electrohydraulic control module
2 Crankcase
3 Cylinder
4 Tappet guide
5 Connection part
6 Intermediate housing
7 Control housing
8 Electrical switching valve
9 Current rails
10 Current plug
11 Top side
12 Channel
13 Seal
14 Oil feed line
15 Seal
16 Compressed oil connection
17 Control oil line
18 Seal
19 Oil-free passage bores
20 Bottom side

The invention claimed is:

1. An electrohydraulic control module for making available pressurized oil for actuators, which are used for actuating control units for switching gas-exchange valves of an internal combustion engine on and off, comprising a control housing, which is attached to a connection part of the internal combustion engine and which has electrical switching valves that are connected to an oil supply line and to control oil lines leading to the actuators, and an intermediate housing, which is injection molded from plastic and which has at least the oil supply line and the control oil lines, is clamped between the connection part and the control housing, the oil supply line is constructed as a channel in the intermediate housing, which is open towards the control housing and which is surrounded by a seal integrated in the plastic of the intermediate housing and closed by the control housing.

2. The control module according to claim 1, wherein the channel is in fluid connection via an oil feed line with pressurized oil connection of the connection part, the oil feed line is constructed as a passage line, whose ends are surrounded by an integrated seal in the intermediate housing.

3. The control module according to claim 1, wherein the control oil lines in the intermediate housing are constructed as passage lines, whose ends are surrounded by integrated seals and with which the control oil lines of the control housing and the connection part are connected in a pressure-tight manner.

4. The control module according to claim 3, wherein the integrated seals are constructed as closed elastomer cords and are connected to each other and by the molding process to the plastic of the intermediate housing.

5. The control module according to claim 4, wherein oil-free passage bores aligned relative to each other are provided in the control housing and in the intermediate housing.

6. The control module according to claim 4, wherein a profile of the channel extending in a longitudinal direction of the intermediate housing is adapted through corresponding bends in the channel to a position of the electrical switching valves and the oil feed line as well as to the oil-free passage bores.

7. The control module according to claim 6, wherein the intermediate housing is constructed free from undercuts in an opening direction of an injection-molding die.

* * * * *